US008453886B2

(12) United States Patent
Ikushima

(10) Patent No.: US 8,453,886 B2
(45) Date of Patent: Jun. 4, 2013

(54) DEVICE AND METHOD FOR DISCHARGING CONSTANT AMOUNT OF HIGH-VISCOSITY MATERIAL

(75) Inventor: Kazumasa Ikushima, Mitaka (JP)

(73) Assignee: Musashi Engineering, Inc., Mitaka-shi, Tokyo (JP)

( * ) Notice: Subject to any disclaimer, the term of this patent is extended or adjusted under 35 U.S.C. 154(b) by 0 days.

(21) Appl. No.: 13/378,076

(22) PCT Filed: Jun. 11, 2010

(86) PCT No.: PCT/JP2010/059907
§ 371 (c)(1),
(2), (4) Date: Feb. 28, 2012

(87) PCT Pub. No.: WO2010/147054
PCT Pub. Date: Dec. 23, 2010

(65) Prior Publication Data

US 2012/0145743 A1 Jun. 14, 2012

(30) Foreign Application Priority Data

Jun. 15, 2009 (JP) ..... 2009-142788

(51) Int. Cl.

| | |
|---|---|
| ***G01F 11/00*** | (2006.01) |
| ***B67B 7/00*** | (2006.01) |
| ***B67D 1/00*** | (2006.01) |
| ***B67D 7/14*** | (2010.01) |
| ***B67D 7/70*** | (2010.01) |
| ***F16K 31/12*** | (2006.01) |
| ***F16K 31/36*** | (2006.01) |

(52) U.S. Cl.
USPC ..... 222/260; 222/1; 222/64; 222/254; 222/262; 222/263; 137/487.5

(58) Field of Classification Search
USPC ..... 222/1, 64, 260, 252, 254, 256, 262, 222/263, 380, 394, 504, 559; 137/14, 487.5, 137/565.3
See application file for complete search history.

(56) References Cited

U.S. PATENT DOCUMENTS

| | | | | |
|---|---|---|---|---|
| 6,082,247 | A * | 7/2000 | Beaulicu | 99/302 R |
| 6,715,506 | B1 * | 4/2004 | Ikushima | 137/14 |
| 6,799,698 | B2 | 10/2004 | Ono et al. | |
| 2004/0164091 | A1 | 8/2004 | Ono et al. | |
| 2009/0236366 | A1 | 9/2009 | Ikushima | |

FOREIGN PATENT DOCUMENTS

| | | | |
|---|---|---|---|
| EP | 1123750 | A1 * | 8/2001 |
| JP | 9-299861 | A | 11/1997 |

(Continued)

OTHER PUBLICATIONS

International Search Report of PCT/JP2010/059907, date of mailing date Sep. 7, 2010.

*Primary Examiner* — Paul R Durand
*Assistant Examiner* — Benjamin R Shaw
(74) *Attorney, Agent, or Firm* — Westerman, Hattori, Daniels & Adrian, LLP

(57) ABSTRACT

A device for discharging a constant amount of a high-viscosity material, capable of accurately discharging the material even if the material is sent under high pressure. A device for discharging a constant amount of a high-viscosity material, provided with: a discharge unit (400) having a discharge opening which discharges the high-viscosity material; a holding unit (300) having a holding area which holds the high-viscosity material, a receiving opening which supplies the high-viscosity material to the holding area, and a delivery opening which delivers the high-viscosity material to the discharge unit; and a high-pressure supply pump (100) for supplying to the holding unit under a first pressure the high-viscosity material having been filled into a container. A liquid sending unit (200) having a pump mechanism and a valve mechanism is provided in the flow path for connecting the high-pressure supply pump (100) and the holding unit (300), and the liquid sending unit sends the high-viscosity material to the holding unit by a second pressure adjusted to a lower pressure than the first pressure.

9 Claims, 10 Drawing Sheets

FOREIGN PATENT DOCUMENTS

| | | | | |
|---|---|---|---|---|
| JP | 2000135465 | A | * | 5/2000 |
| JP | 2004-249243 | A | | 9/2004 |
| JP | 2004-332638 | A | | 11/2004 |
| WO | 2005/092515 | A1 | | 10/2005 |
| WO | 2007/046495 | A1 | | 4/2007 |

* cited by examiner

DEVICE AND METHOD FOR DISCHARGING CONSTANT AMOUNT OF HIGH-VISCOSITY MATERIAL

TECHNICAL FIELD

The present invention relates to a device and a method for ejecting a high-viscosity material, such as grease, oil, a paste-like material, or a creamy material, in a constant amount with good accuracy.

BACKGROUND ART

Patent Document 1 discloses, as a supply device for supplying a high-viscosity material, e.g., grease, in a constant amount, a material supply device for supplying a fluidal material by ejecting the material from a nozzle, the device comprising container means for containing the material, ejection means for ejecting the material delivered from the container means, first delivery means for delivering the material from the container means to the ejection means, backup material storage means for storing, as backup, the material delivered from the container means and delivering the backup material to the ejection means when the material in the container means has run out, and second delivery means for delivering the material from the container means to the backup material storage means, wherein the second delivery means is connected to a material inlet port of the backup material storage means, and a material supply port of the backup material storage means is connected to the ejection means side.

Also, Patent Document 2 discloses a material supply system comprising a supply device for sucking a material to be supplied, which is stored in a storage unit, e.g., a container tank, and supplying the sucked material in a high-pressure state, an ejection device for supplying the material in a constant amount to a work, a supply line connecting a supply port of the supply device and a suction port of the ejection device to each other, the supply line including a pressure reducing valve capable of setting a pressure reduction ratio and an on-off valve, a pressure sensor for detecting a pressure near the suction port of the ejection device, and control means for, in accordance with a pressure signal from the pressure sensor, closing the on-off valve when the pressure near the suction port of the ejection device exceeds above a preset upper limit value, and opening the on-off valve when the pressure near the suction port of the ejection device exceeds below a preset lower limit value, wherein an accumulator is disposed in the supply line between the on-off valve and the suction port of the ejection device, the accumulator holding the pressure near the suction port of the ejection device from exceeding above the preset upper limit value or exceeding below the preset lower limit value in a short time in a state where the pressure reduction ratio of the pressure reducing valve is set to a level lower than a pressure adapted for causing the material to flow at a full rate during operation of the ejection device.

PRIOR ART LIST

Patent Document 1: Japanese Patent Laid-Open Publication No. H9-299861

Patent Document 2: Japanese Patent Laid-Open Publication No. 2004-249243

SUMMARY OF THE INVENTION

Problems to be Solved by the Invention

In the above-described devices disclosed as the prior art, when the high-viscosity material contained in the container means or the container tank is fed to the ejection means or the ejection device, a liquid feed pressure of a pump for pumping out the liquid material from the container is controlled for the feeding of the material.

However, there is a difficulty in sufficiently eliminating a pressure variation attributable to, e.g., pulsation of the liquid material that is fed through a flow path, i.e., liquid feed path, filled with the liquid material, and the pressure variation of the liquid material supplied to the ejection means causes a variation in the ejection amount of the liquid material.

More specifically, because the device disclosed in Embodiment 1 in Patent Document 1 ejects the liquid material under a pressure given by a liquid-material pressure feed pump that is positioned at an opposite end of a flow path communicating with an ejection valve, it is difficult to keep constant a pressure near the ejection valve that is positioned in the flow path farthest away from the ejection valve. Further, in the device disclosed in an embodiment according to the invention of Patent Document 2, because the pressure produced by a plunger pump (supply device) is supplied to the ejection device through the accumulator, a variation occurs in the supply pressure of the material as discussed in paragraph [0033] of Patent Document 2.

The present invention has been accomplished in view of the above-described state of the art, and an object of the present invention is to provide an ejection device and method for high-accurately ejecting even a high-viscosity material fed under a high pressure.

Means for Solving the Problems

To solve the above-discussed problems and to achieve the above object, the device according to the present invention is constituted as follows:

[1] A device for ejecting a high-viscosity material in a constant amount, the device comprising an ejection unit having an ejection port through which the high-viscosity material is ejected, a storage unit having a storage area in which the high-viscosity material is stored, a receiving port through which the high-viscosity material is supplied to the storage area, and a delivery port through which the high-viscosity material is delivered to the ejection unit, a high-pressure supply pump for supplying the high-viscosity material, which is filled in a container, to the storage unit under a first pressure, and a control unit, wherein a liquid feed unit is disposed in a flow path communicating the high-pressure supply pump and the storage unit with each other, and the high-viscosity material is supplied to the storage unit by the liquid feed unit under a second pressure that is regulated to be lower than the first pressure.

[2] In the device for ejecting the high-viscosity material in the constant amount, described in [1], the storage unit stores the high-viscosity material while a space regulated to be held at a third pressure is maintained in an upper portion of the storage area, and the liquid feed unit supplies the high-viscosity material to the storage unit under the second pressure that is lower than the first pressure and higher than the third pressure.

[3] In the device for ejecting the high-viscosity material in the constant amount, described in [1] or [2], the delivery port is disposed in a lower portion of the storage area, the receiving port is disposed in the storage area at a position above the delivery port, and a cross-sectional area of the storage area is set to be larger than a cross-sectional area of the delivery port.

[4] In the device for ejecting the high-viscosity material in the constant amount, described in any one of [1] to [3], a sensor for monitoring a storage amount of the high-viscosity material, which is stored in the storage unit, at a position above the receiving port is disposed in the storage unit, and the control unit operates the liquid feed unit in accordance with a signal from the sensor such that the high-viscosity material is replenished to the storage unit.

[5] In the device for ejecting the high-viscosity material in the constant amount, described in any one of [1] to [4], the liquid feed unit includes a pump mechanism for delivering the high-viscosity material supplied from the high-pressure supply pump to the storage unit, and a valve mechanism selectively taking a first position at which the liquid feed unit is communicated with the high-pressure supply pump and communication with the storage unit is cut off, and a second position at which the liquid feed unit is communicated with the storage unit and communication with the high-pressure supply pump is cut off.

To solve the above-discussed problems and to achieve the above object, the method according to the present invention is constituted as follows:

[6] A method for ejecting a high-viscosity material in a constant amount, the method preparing an ejection unit having an ejection port through which the high-viscosity material is ejected, a storage unit having a storage area in which the high-viscosity material is stored, a receiving port through which the high-viscosity material is supplied to the storage area, and a delivery port through which the high-viscosity material is delivered to the ejection unit, and a high-pressure supply pump for supplying the high-viscosity material, which is filled in a container, to the storage unit under a first pressure, wherein a liquid feed unit including a pump mechanism and a valve mechanism is disposed in a flow path communicating the high-pressure supply pump and the storage unit with each other, and the high-viscosity material is supplied to the storage unit by the liquid feed unit under a second pressure that is regulated to be lower than the first pressure.

[7] In the method for ejecting the high-viscosity material in the constant amount, described in [6], the storage unit stores the high-viscosity material while a space regulated to be held at a third pressure is maintained in an upper portion of the storage area, and the liquid feed unit supplies the high-viscosity material to the storage unit under the second pressure that is lower than the first pressure and higher than the third pressure.

[8] In the method for ejecting the high-viscosity material in the constant amount, described in [6] or [7], the delivery port is disposed in a lower portion of the storage area, the receiving port is disposed in the storage area at a position above the delivery port, and a cross-sectional area of the storage area is set to be larger than a cross-sectional area of the delivery port.

[9] In the method for ejecting the high-viscosity material in the constant amount, described in any one of [6] to [8], a sensor for monitoring a storage amount of the high-viscosity material, which is stored in the storage unit, at a position above the receiving port is disposed in the storage unit, and the control unit operates the liquid feed unit in accordance with a signal from the sensor such that the high-viscosity material is replenished to the storage unit.

ADVANTAGEOUS EFFECT OF THE INVENTION

According to the present invention, since a new pressure supply source is employed which is separated in terms of pressure from the high-pressure pump for pumping out the high-viscosity material contained in the container tank, the high-viscosity material can be supplied to the ejection unit in such a state that a pressure variation is very small. Hence, the high-viscosity material can be ejected from the ejection unit with high accuracy free from a variation.

MODE FOR CARRYING OUT THE INVENTION

Figure 1:
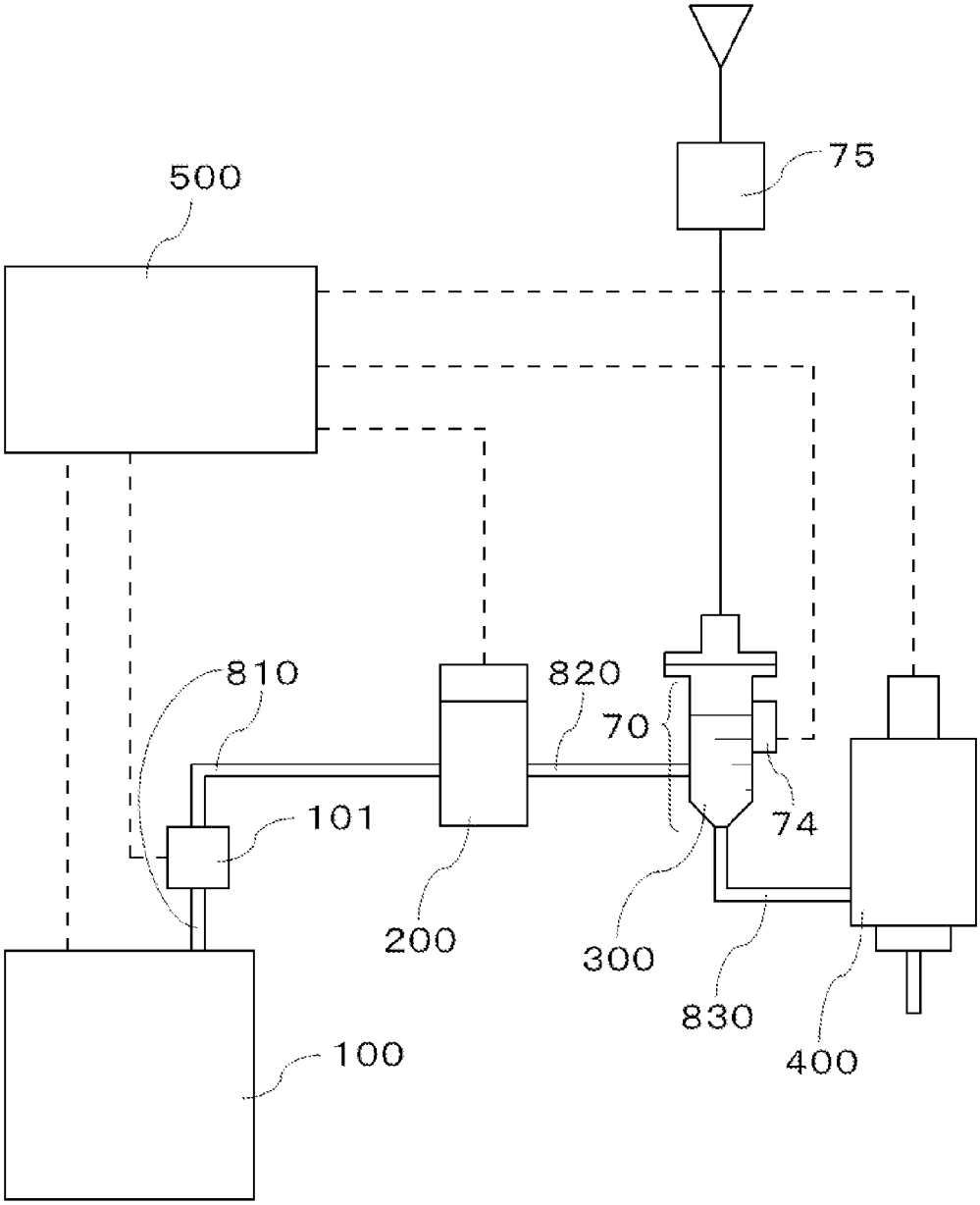
FIG. 1 is a schematic view illustrating one form of a constant-amount ejection device according to the present invention.
Figure 2:
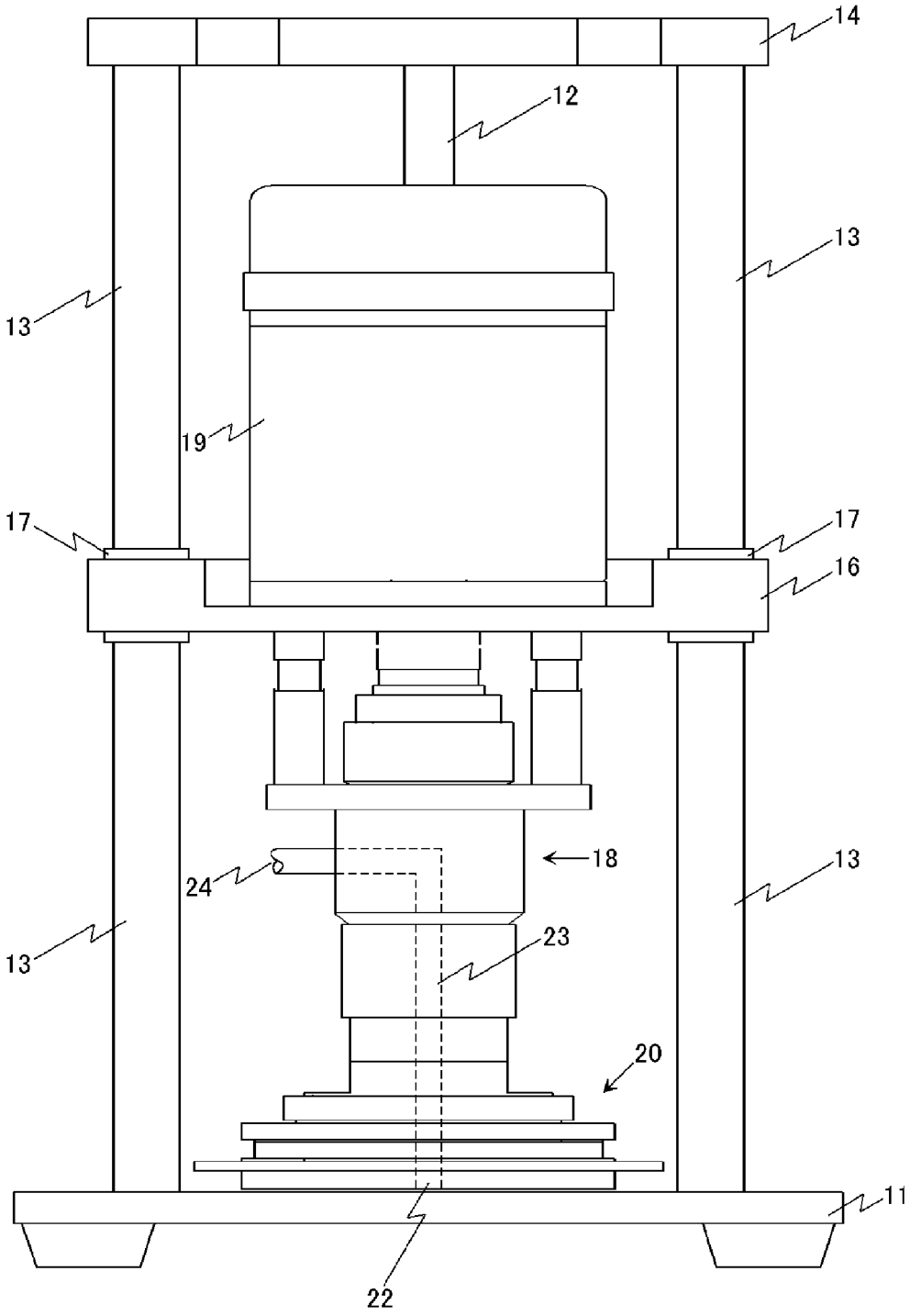
FIG. 2 is a schematic front view of a high-pressure supply pump for use in an example.

A device for ejecting a high-viscosity material in a constant amount, according to the present invention, includes a high-pressure supply pump 100, a liquid feed unit 200, a storage unit 300, an ejection device 400, and a control unit 500 as main components. As illustrated in FIG. 1, those components are successively communicated between them through liquid feed pipes in the order of the high-pressure supply pump 100, the liquid feed unit 200, the storage unit 300, and the ejection device 400. More specifically, the high-pressure supply pump 100 and the liquid feed unit 200 are communicated with each other through a liquid feed pipe A 810, the liquid feed unit 200 and the storage unit 300 are communicated with each other through a liquid feed pipe B 820, and the storage unit 300 and the ejection device 400 are communicated with each other through a liquid feed pipe C 830.

The high-pressure supply pump 100 pumps out the high-viscosity material from a container (supply source) in which the high-viscosity material is filled, and feeds the high-viscosity material to the liquid feed unit 200. The container is, e.g., a pail can, a grease can, or a 18-liter square can. The high-pressure supply pump usable here is, e.g., a pressure feed device for high-viscosity materials, which is disclosed in Japanese Patent Laid-Open Publication No. 2004-332638 filed by the applicant.

The liquid feed unit 200 serves to feed the high-viscosity material having been fed under a high pressure from the high-pressure supply pump 100 to the storage unit 300 at a pressure (second pressure) that is regulated to be lower than a supply pressure (first pressure) of the high-viscosity material from the high-pressure supply pump 100.

The liquid feed unit 200 includes a pump mechanism for delivering the high-viscosity material supplied from the high-pressure supply pump 100 to the storage unit 300, and a valve mechanism. The valve mechanism is constituted by a selector valve for cutting off the communication between the pump mechanism and the storage unit 300 when the pump mechanism receives the high-viscosity material supplied from the high-pressure supply pump, and for cutting off the communication between the pump mechanism and the high-pressure supply pump 100 when the pump mechanism supplies the high-viscosity material to the storage unit 300. The valve mechanism can be constituted, for example, by using a selector valve of the slide type, the unidirectional rotation type, or the reciprocal rotation type.

Preferably, the second pressure is sufficiently lower than the first pressure and is set to a level exceeding a pressure (third pressure) in a space that is maintained in an upper portion of a later-described storage area 70 in the storage unit 300.

The storage unit 300 serves to temporarily store the high-viscosity material before supplying the high-viscosity material to the ejection unit 400. The storage unit 300 includes the storage area 70 in which the high-viscosity material is stored such that a space is formed in the upper portion of the storage area 70 at all times. Further, the space in the upper portion of the storage area 70 is regulated to be held at a constant pressure at all times by a pressurization source that is connected to the storage unit 300 through a pressure reducing valve 75.

An amount of the high-viscosity material stored in the storage area 70 is adjusted so as to fall within a predetermined range at all times by using a storage amount sensor 74.

Important points in arrangement of the storage unit 300 are that an delivery port through which the high-viscosity material is delivered from the storage area 70 to the ejection unit 400 is disposed below an inlet port through which the high-viscosity material is received, and that a cross-sectional area of the storage area 70 (i.e., a diameter of a storage container) is set to be sufficiently larger than a cross-sectional area of the delivery port (i.e., a diameter of a flow path) (for example, several times or more in the cross-sectional area). With such an arrangement, flow resistance in a direction toward the upper portion of the storage area 70 (i.e., toward a liquid surface) is sufficiently smaller than that in a direction toward the delivery port. Accordingly, influences of a pressure variation and pulsation, which are possibly caused upon the high-viscosity material being supplied from the liquid feed unit 200, can be minimized.

The ejection unit 400 can be constituted by one of known ejection devices. For example, an ejection device of the jet type disclosed in Japanese Patent Laid-Open Publication No. 2002-282740, an ejection device of the screw type disclosed in Japanese Patent Laid-Open Publication No. 2002-326715, or an ejection device of the plunger type disclosed in WO 2007/046495 can be used.

The ejection unit 400 is preferably positioned close to the storage unit 300. Also, the ejection unit 400 is preferably constructed integrally with the storage unit 300 such that its position relative to the storage unit 300 is not changed. Further, the ejection unit 400 is preferably communicated with the storage unit 300 through the liquid feed pipe C that is made of a hard material, such as SUS.

The control unit 500 is electrically connected to the high-pressure supply pump 100, the liquid feed unit 200, the storage unit 300, and the ejection device 400, and it controls operations of those components.

A mode for carrying out the present invention will be described below in connection with Example, but the present invention is in no way restricted by the following Example.

EXAMPLE

<<Construction>>

The construction of a device for ejecting a high-viscosity material in a constant amount, according to Example, is similar to that illustrated in FIG. 1, and it includes the high-pressure supply pump 100, the liquid feed unit 200, the storage unit 300, the ejection device 400, and the control unit 500 as main components. Detailed constructions of those components will be described below.

[High-Pressure Supply Pump 100]

A pressure feed device constituting the high-pressure supply pump 100 in this Example will be described below with reference to FIGS. 2 to 6.

The illustrated device is a high-viscosity material pressure feed device in which, for taking out and pressure-feeding a high-viscosity material stored in a can 21 from the can 21, a follow plate 20 for sealing an upper surface of the can 21 and pressurizing the high-viscosity material is disposed at a lower end of a pump means 18 that is ascended and descended with respect to the can 21. The pressure feed device further includes a movable plate 16 holding the pump means, a cylinder 15 for ascending and descending the movable plate 16, an ascent/descent guide 13 for guiding the movement of the movable plate 16. The ascent/descent guide 13 is disposed at a position behind the pump means 18 and in front of the cylinder 15.

Figure 3:
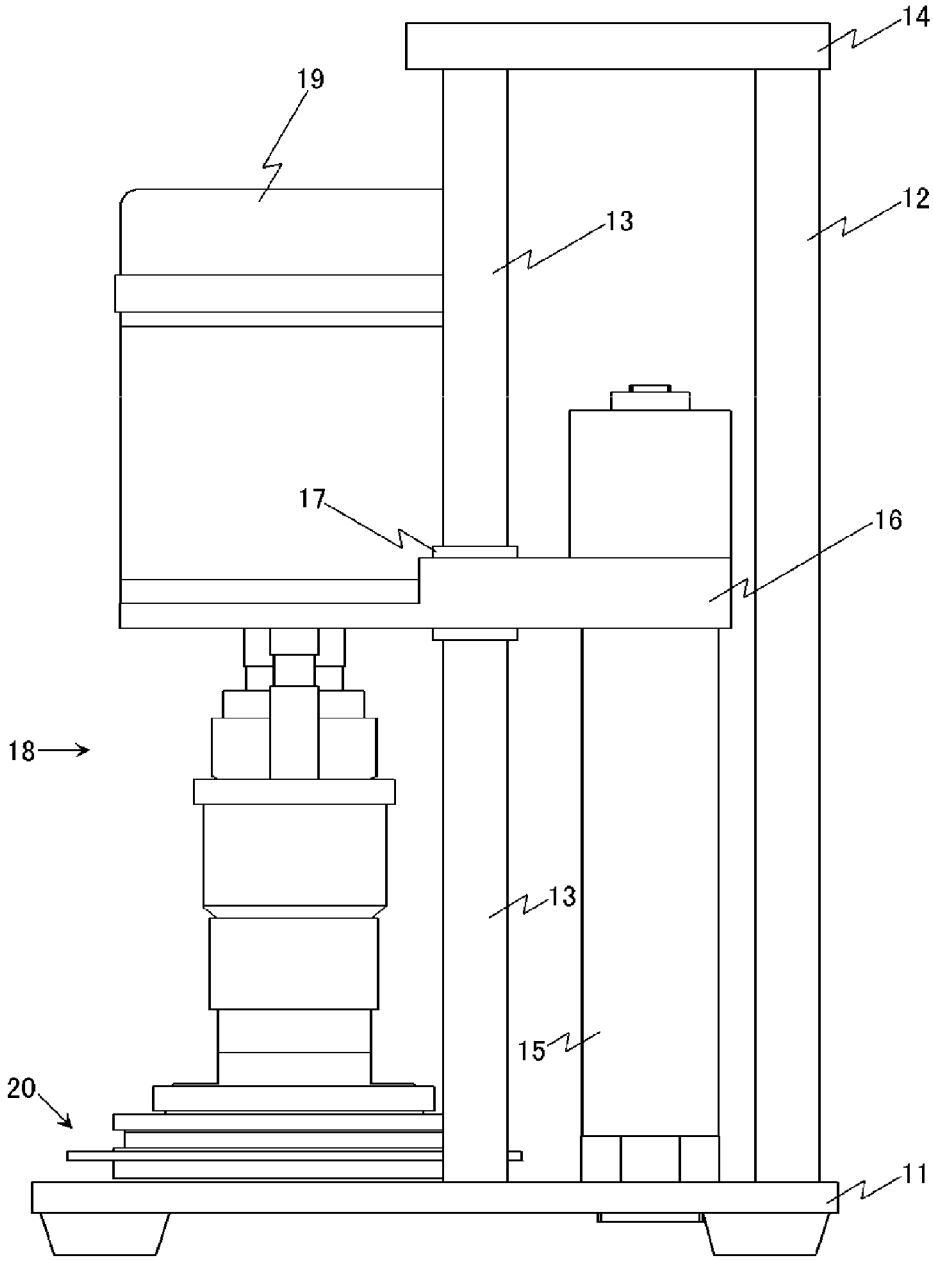
FIG. 3 is a schematic side view of the high-pressure supply pump for use in the example.
Figure 4:
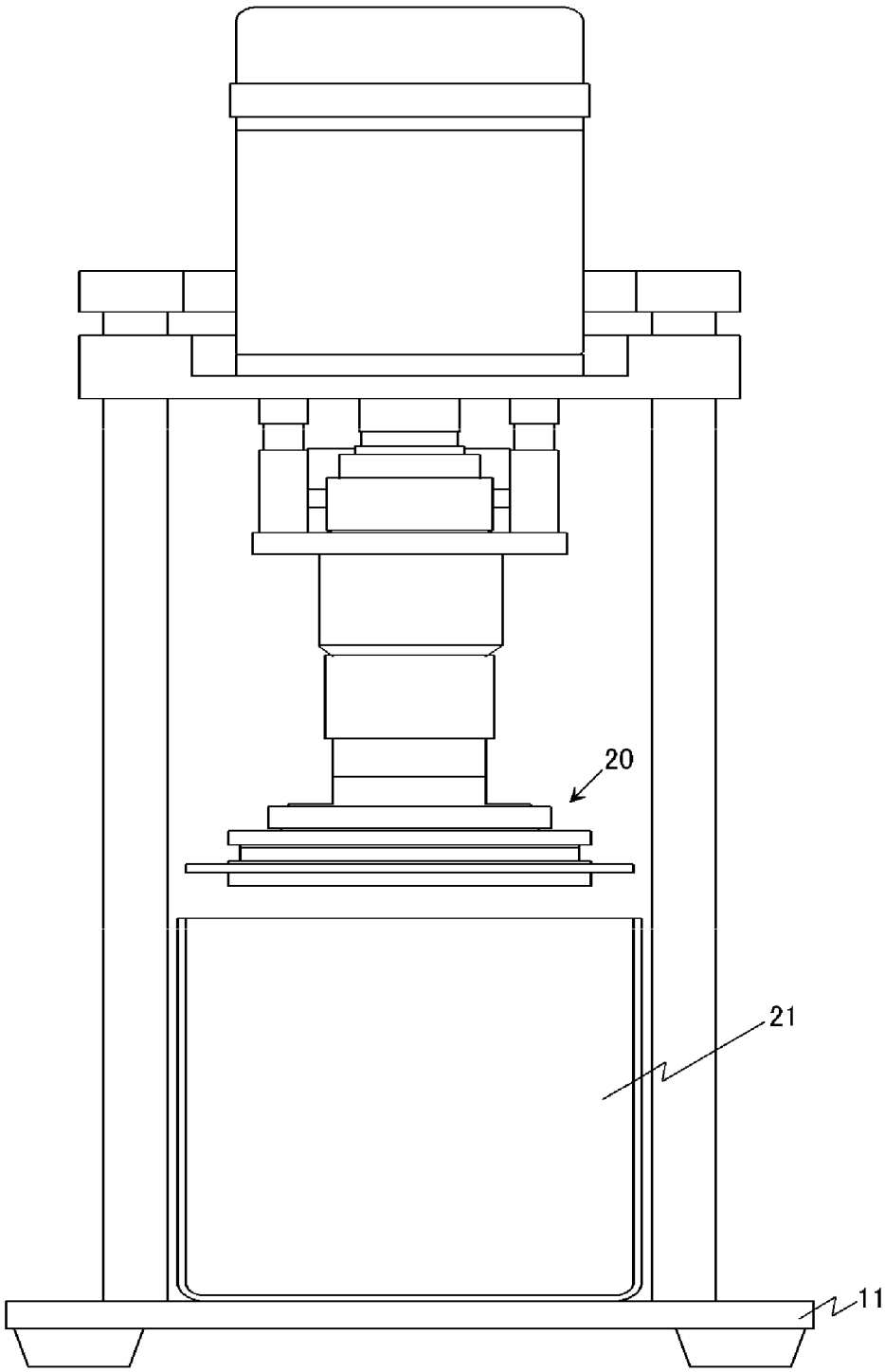
FIG. 4 is an explanatory view to explain a state at the start of a pressure feed operation by the high-pressure supply pump.
Figure 5:
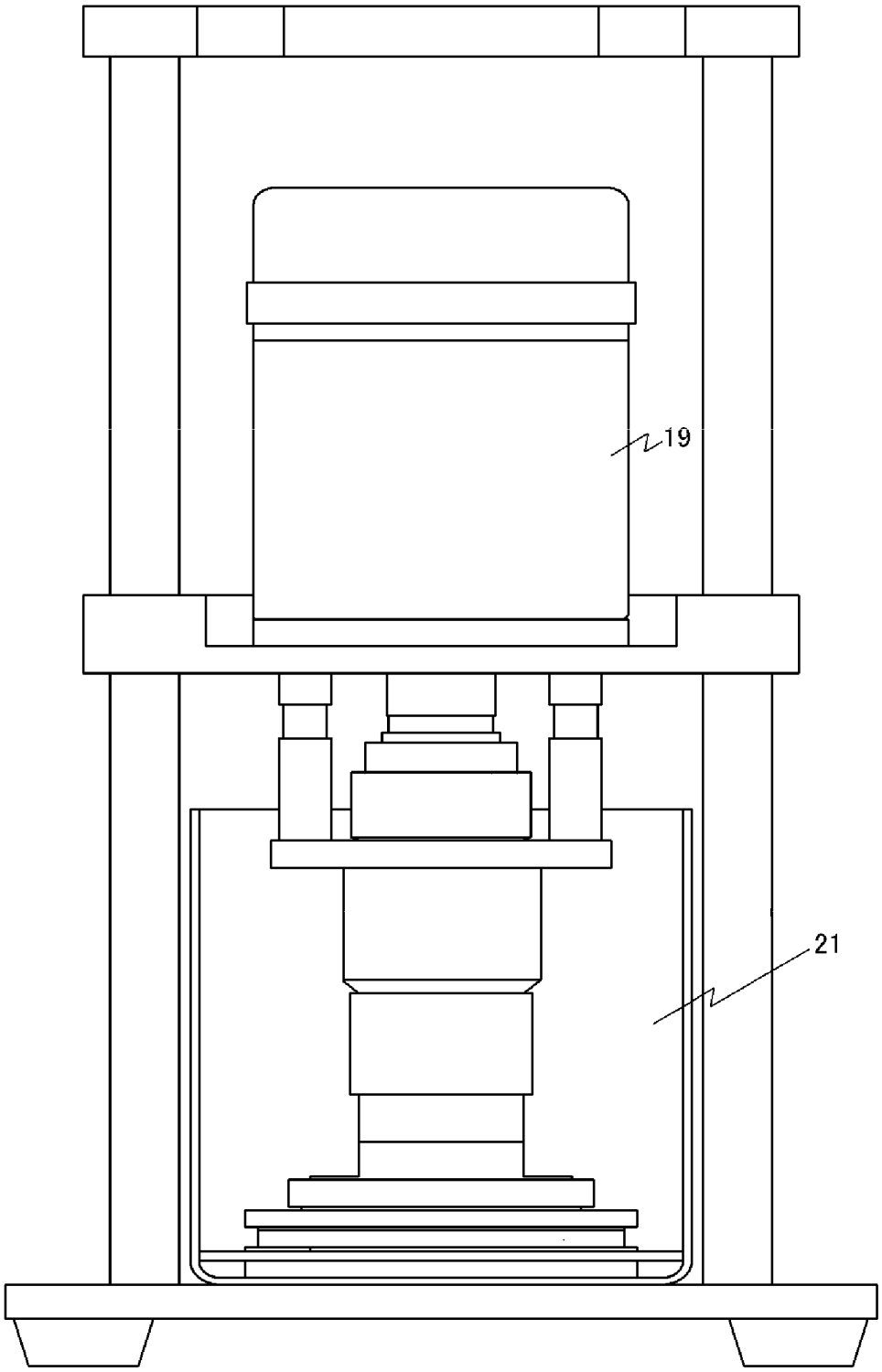
FIG. 5 is an explanatory view to explain a state at the end of the pressure feed operation by the high-pressure supply pump.

As illustrated in FIGS. 3 to 5, the pump means 18 includes the follow plate 20 for sealing and pressurizing the upper surface of the high-viscosity material in the can 21, the follow plate 20 being fixed to a lower surface of the movable plate 16, and a shovel plate 28 disposed at a position corresponding to a lower end of the follow plate 20.

Figure 6:
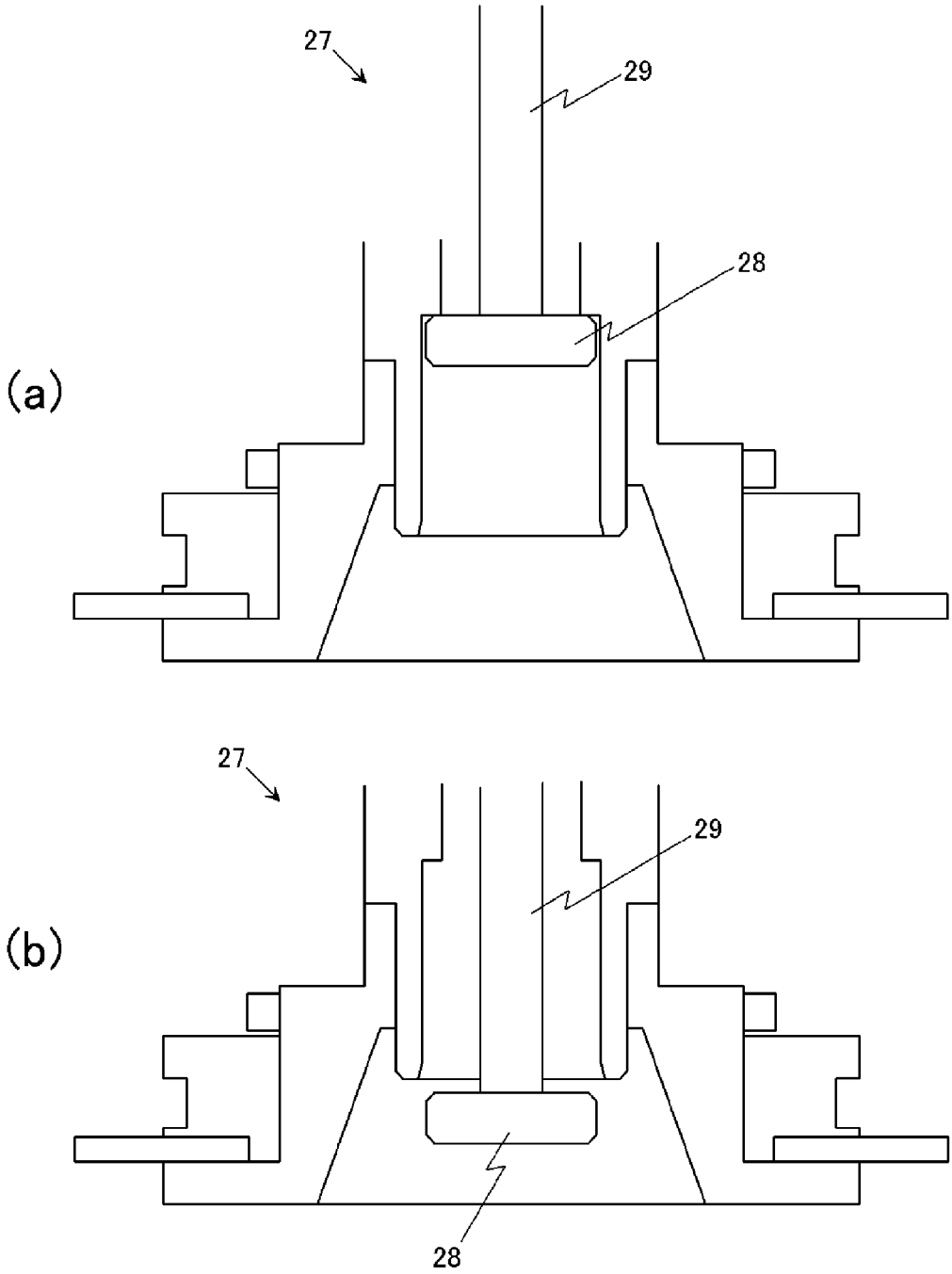
FIG. 6(*a*) is an enlarged sectional view when a shovel body of a follow-plate unit is in an ascended state, and FIG. 6(*b*) is an enlarged sectional view when the shovel body of the follow-plate unit is in a descended state.

As illustrated in FIG. 6, a shovel body 27 includes the shovel plate 28 and a shaft 29 extending from the shovel plate 28. The shaft 29 is inserted through a delivery pipe 23 formed inside the pump means 18, and it is coupled to an air motor 30 fixed to an upper surface of the movable plate 16. In conjunction with operation of the air motor 30, the shaft 29 and hence the shovel plate 28 are moved up and down to scoop the high-viscosity material into the delivery pipe 23. In such a way, the pump means 18 applies a high pressure to the high-viscosity material and delivers the high-viscosity material.

The high-pressure supply pump 100 in this Example is operated when a pressure sensor 101 disposed in the liquid feed pipe A 810 communicating the high-pressure supply pump 100 and the liquid feed unit 200 with each other detects 90 $kgf/cm^2$, and it stops the operation when the detected pressure exceeds 110 $kgf/cm^2$. In other words, the pressure of the high-viscosity material in the liquid feed pipe A 810 is maintained at a high pressure of about 100 $kgf/cm^2$. It is needless to say that the liquid feed pipe A 810 is formed of a pipe endurable against the above-mentioned high pressure.

[Liquid Feed Unit 200]

The liquid feed unit 200 feeds the high-viscosity material having been fed under the high pressure from the high-pressure supply pump 100 to the storage unit 300 at a pressure (e.g., about 3 to 7 kgf/cm$^2$) that is lower than the supply pressure provided by the high-pressure supply pump 100.

The liquid feed unit 200 in this Example has a pump function of feeding the high-viscosity material to the storage unit 300 without resorting to the high-pressure supply pump 100.

Figure 7:
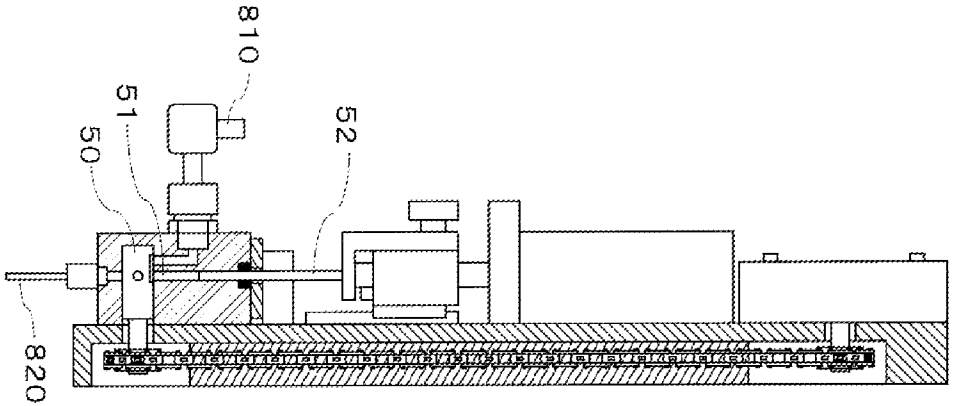
FIG. 7 is a schematic side view of a liquid feed unit for use in the example.

The liquid feed unit 200 in this Example is constructed as illustrated in FIG. 7.

A selector valve 50 is operated to selectively take one of two positions, i.e., a first position at which the liquid feed pipe A 810 and a measuring hole 51 are communicated with each other, and a second position at which the measuring hole 51 and the liquid feed pipe B 820 are communicated with each other.

A plunger 52 sucks the high-viscosity material into the measuring hole 51 when it is moved in a direction away from the selector valve 50 (i.e., upward direction), and discharges the high-viscosity material having been sucked into the measuring hole 51 when it is moved in a direction toward the selector valve 50 (i.e., downward direction).

A liquid feed operation will be described below.

The high-viscosity material having been fed from the high-pressure supply pump 100 is sucked into the measuring hole 51 by shifting the selector valve 50 to the first position and moving the plunger 52 in the direction away from the selector valve 50.

Next, the selector valve 50 is shifted to the second position and the plunger 52 is then moved in the direction toward the selector valve 50, thereby discharging the high-viscosity material having been sucked into the measuring hole 51. As a result, the high-viscosity material is fed to the storage unit 300 from the liquid feed unit 200.

In such a way, since the selector valve 50 is operated to selectively take one of the first position and the second position, the high-pressure supply pump 10 is avoided from being directly communicated with the storage unit 300. Accordingly, the high pressure from the high-pressure supply pump 10 can be prevented from directly acting on the storage unit 300.

Stated another way, the liquid feed pressure produced by the high-pressure supply pump 100 acts to feed the high-viscosity material from the high-pressure supply pump 100 to the liquid feed unit 200, whereas the liquid feed pressure produced by the liquid feed unit 200 acts to feed the high-viscosity material from the liquid feed unit 200 to the storage unit 300. Thus, the liquid feed pressure for the feeding from the high-pressure supply pump 100 to the liquid feed unit 200 and the liquid feed pressure for the feeding from the liquid feed unit 200 to the storage unit 300 are separated from each other in terms of pressure.

It is needless to say that the liquid feed unit 200 is not limited to the device illustrated in FIG. 7. For example, the liquid feed unit 200 may be a valve-equipped plunger pump capable of being assembled in the ejection device. In such a case, a constant rate valve may be used which acts as a valve communicating with the upstream side during a suction operation of the plunger and communicating with the downstream side during a delivery operation of the plunger (on condition that the upstream side and the downstream side are not directly communicated with each other).

[Storage Unit 300]

Figure 8:
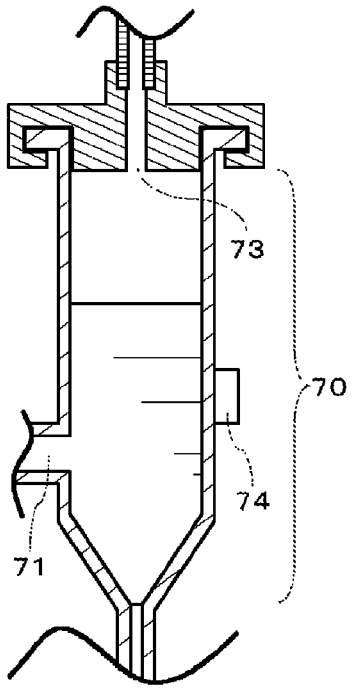
FIG. 8 is a schematic sectional view of a storage unit for use in the example.

The storage unit 300 is disposed between the liquid feed unit 200 and the ejection unit 400 to temporarily store the high-viscosity material. As illustrated in FIG. 8, the storage unit 300 includes the storage area 70 in which the high-viscosity material is temporarily stored.

An inlet port 71 through which the high-viscosity material is supplied from the storage unit 300 is provided at a position below a center of the storage area 70 in the vertical direction, and a delivery port 72 through which the high-viscosity material is delivered to the ejection unit 400 is disposed at a lowermost portion of the storage area 70.

Further, an air pressure regulation port 73 is provided at an uppermost portion of the storage area 70, and an air pressure in the storage area 70 is regulated to be held at a constant level at all times by the pressure reducing valve 75 that is communicated with the storage area 70 through the air pressure regulation port 73. The high-viscosity material stored in the storage area 70 is fed to the ejection device 400 under the regulated pressure.

Additionally, the air pressure in the storage area 70 under regulation by the pressure reducing valve 75 is regulated to be lower than the liquid feed pressure provided by the liquid feed unit 200.

An amount of the high-viscosity material stored in the storage area 70 is set such that a space is maintained above the water head position in the storage area 70 at all times. In other words, the high-viscosity material stored in the storage area 70 inside the storage unit 300 should not be accumulated to such an extent that the high-viscosity material reaches the height of the air pressure regulation port 73. To satisfy such a condition, a liquid surface sensor 74 for detecting a liquid surface position of the high-viscosity material in the storage area 70 is disposed in the storage unit 300. With the provision of the liquid surface sensor 74, the liquid surface position can be prevented from becoming lower than the height at which the receiving port 71 is provided, and the space can be surely formed and maintained at all times above the water head position of the high-viscosity material stored in the storage area 70.

The liquid surface sensor 74 in this Example sends a signal to the control unit 500 when the liquid surface position becomes lower than the position at which the liquid surface is detected, and it stops the sending of the signal when the liquid surface position becomes higher than the detection position. The detection position is adjusted to be able to detect the liquid surface position above the receiving port 71.

Thus, by detecting the liquid surface with the liquid surface sensor 74, it is possible to prevent the liquid surface position from becoming lower than the position at which the receiving port 71 is provided, and to prevent the high-viscosity material from filling the storage area 70 until reaching the air pressure regulation port 73.

As a modification, the liquid surface sensor 74 may be constituted by two liquid surface sensors, and an upper limit and a lower limit may be set specified for the water head position of the high-viscosity material such that the high-viscosity material is stored in a range between the upper limit and the lower limit.

[Ejection Unit 400]

The ejection unit 400 is an ejection device for ejecting the high-viscosity material to an objective position. The ejection device constituting the ejection unit 400 can be of, e.g., the jet type, the screw type, or the plunger type.

The ejection device in this Example is employed in such a state that the storage unit 300, the liquid feed pipe C 830, and the ejection unit 400 are mounted on a head of an application robot.

Alternatively, an on-off valve may be used as the ejection unit. In such a case, the pressure regulated by the pressure reducing valve 75 acts as an ejection pressure for ejecting the high-viscosity material.

[Control Unit 500]

The control unit 500 receives the signal from the liquid surface sensor in the storage unit 300 and controls the operation of the ejection unit 400, the operation of the liquid feed unit 200, and the operation of the high-pressure supply pump 100.

<Operation>

Procedures for transferring the high-viscosity material in the container to the liquid feed unit 200 by the high-pressure supply pump 100, transferring the high-viscosity material from the liquid feed unit 200 to the storage unit 300, transferring the high-viscosity material from the storage unit 300 to the ejection unit 400, and ejecting the high-viscosity material in a desired amount from the ejection unit 400 are carried out as described above.

Subsequently, when the ejection of the high-viscosity material from the ejection unit 400 is repeated, the water head position of the high-viscosity material in the storage unit 300 gradually lowers. When the water head position becomes lower than the detection position of the liquid surface sensor 74, a signal is sent from the liquid surface sensor 74 to the control unit 500, whereupon the control unit 500 operates the liquid feed unit 200. With the operation of the liquid feed unit 200, the water head position of the high-viscosity material in the storage unit 300 rises and the liquid surface sensor 74 stops the sending of the signal upon the water head position exceeding above the detection position of the liquid surface sensor 74. In response to the stop of the signal from the liquid surface sensor 74, the control unit 500 stops the operation of the liquid feed unit 200. The liquid feed unit 200 continuously repeats the reciprocal movement of the plunger 52 and the changeover operation of the selector valve 50 until a command for stopping the operation is issued from the control unit 500.

During the operation of the liquid feed unit 200, the ejection unit 400 continuously executes the ejection operation in parallel to the supply of the high-viscosity material from the liquid feed unit 200 to the storage unit 300.

More details of the operation will be described below with reference to FIGS. 9 and 10. It is to be noted that, in FIGS. 9 and 10, a change of the liquid surface position is exaggeratedly drawn for the sake of convenience in explanation.

Figure 9:
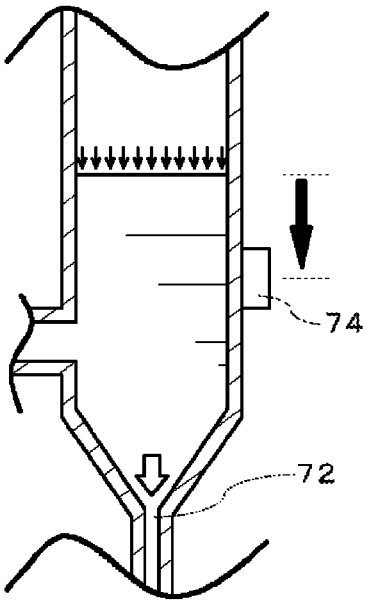
FIG. 9 is an explanatory view of a storage area in a state where a material is not supplied from the liquid feed unit.

FIG. 9 is an explanatory view of the storage area 70 in a state where the material is not supplied from the liquid feed unit 200.

The high-viscosity material stored in the storage area 70 of the storage unit 300 is delivered to the ejection unit 400 from the delivery port 72 through the liquid feed pipe C 830 under the pressure regulated by the pressure reducing valve 75. With the construction including the liquid feed unit 200 according to this Example, since the storage unit 300 and the high-pressure supply pump 100 are not directly communicated with each other, the high-viscosity material in the liquid feed pipe C 830 communicating the storage unit 300 and the liquid feed unit 200 is also under the pressure (e.g., about 1.5 to 3.0 $kgf/cm^2$) that is regulated by the pressure reducing valve 75.

Figure 10:
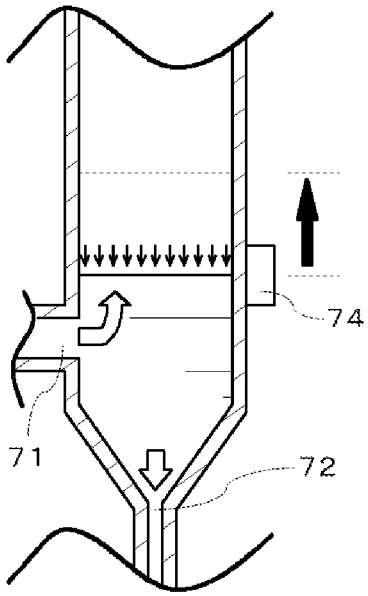
FIG. 10 is an explanatory view of the storage area in a state where the material is supplied from the liquid feed unit.

FIG. 10 is an explanatory view of the storage area 70 in a state where the material is supplied from the liquid feed unit 200.

With the operation of the liquid feed unit 200, the pressure of the high-viscosity material in the liquid feed pipe B 820 rises, whereby the high-viscosity material in the liquid feed pipe B 820 flows into the storage area 70 through the receiving port 71 of the storage unit 300. Here, because the high-viscosity material having entered the storage area 70 preferentially flows in a direction in which flow resistance is relatively small. Therefore, the high-viscosity material flows so as to raise the water head position in the storage area 70, which is formed in a larger diameter (horizontal cross-sectional area) than that of the delivery port 72, instead of passing through the delivery port 72 that is narrowed to have a smaller diameter. As a result, the water head position rises. On the other hand, the feed pressure of the high-viscosity material entering the ejection unit 400 through the liquid feed pipe C 830 is kept in a state released from the applied higher pressure because the water head position rises (namely, the liquid surface ascends).

Thus, according to the device of this Example, even when the high-viscosity material is supplied to the storage unit 300 from the liquid feed unit 200, the feed pressure of the high-viscosity material supplied from the storage unit 300 to the ejection unit 400 is not affected. Therefore, accuracy of the ejection amount of the high-viscosity material ejected from the ejection unit 400 can be avoided from being adversely affected by a variation in the feed pressure of the high-viscosity material supplied from the liquid feed unit 200. While, in this Example, a horizontal cross-sectional area of the storage area 70 is set to be 10 times that of the delivery port 72, similar advantageous effect can also be obtained even when a ratio in the horizontal cross-sectional area therebetween is set to about 5.

Further, the liquid feed pressure in the ejection unit 400 is not affected with the supply of the high-viscosity material from the liquid feed unit 200 to the storage unit 300. Hence, even when the high-viscosity material with pulsation is caused to flow in through the inlet port 71 of the storage unit 70 due to, e.g., the repeated operation of the plunger 52 of the liquid feed unit 200, the liquid feed pressure in the ejection unit 400 is not affected and the pulsation can be eliminated consequently.

Thus, the accuracy of the ejection amount of the high-viscosity material ejected from the ejection unit 400 can be avoided from being affected by the liquid feed pressure.

Moreover, the high-pressure supply pump 100 is operated in accordance with the measured value of the pressure sensor 101 without synchronizing with the ejection operation of the ejection unit 400 such that the pressure in the liquid feed pipe A 810 is held within the specified pressure range. If the pressure in the liquid feed pipe A 810 exceeds below the specified pressure range, the high-pressure supply pump 100 pumps out the high-viscosity material from the container that is filled with the high-viscosity material, whereby the pressure in the liquid feed pipe A 810 rises. When the pressure in the liquid feed pipe A 810 exceeds above the specified pressure range, the operation of the high-pressure supply pump 100 is stopped.

Figure 11:
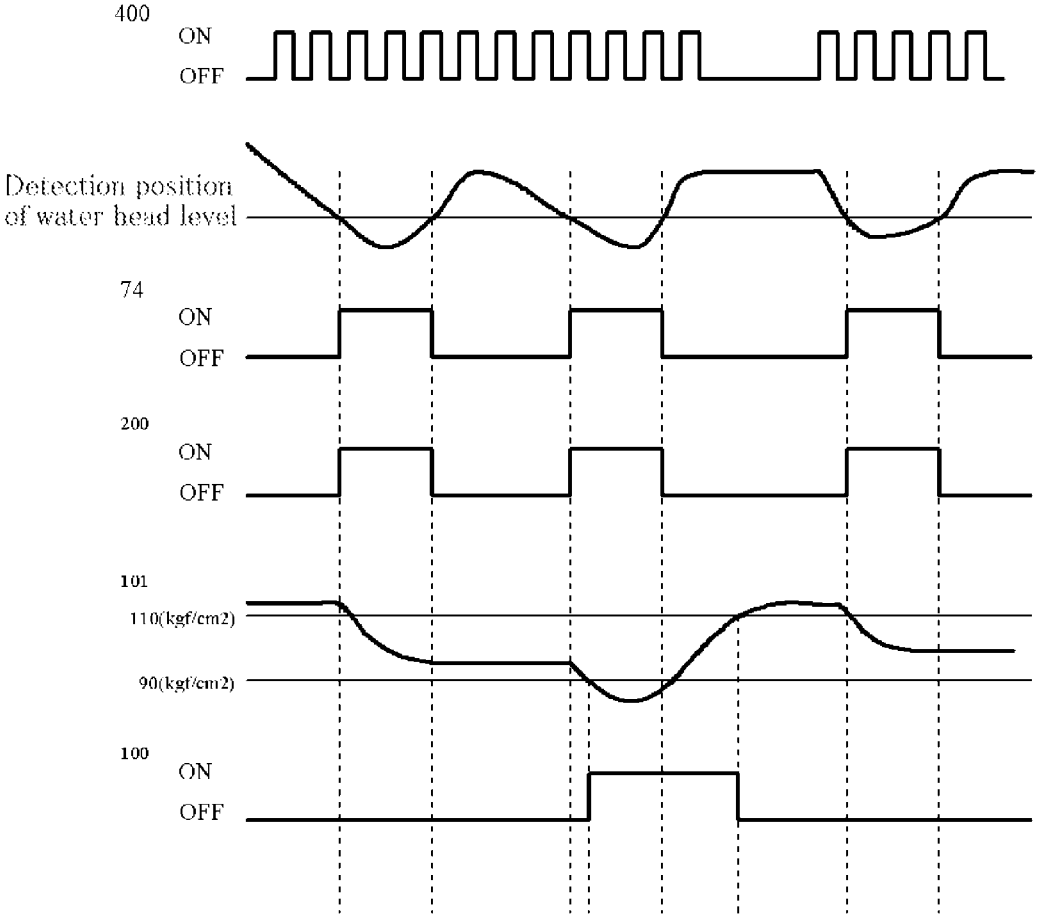
FIG. 11 is a time chart illustrating pressure variations, etc. at various positions in the constant-amount ejection device according to the example.

FIG. 11 is a time chart illustrating pressure variations, etc. at various positions in the constant-amount ejection device according to the example. In FIG. 11, the uppermost column denoted by "400" represents the ON/OFF timing of the ejection device, the second column represents the detection position of the water head level in the storage area 70, and the third column denoted by "74" represents the ON/OFF timing of a signal output from the liquid surface sensor. The fourth column denoted by "200" represents the ON/OFF timing of the operation of the liquid feed unit, the fifth column denoted by "101" represents the pressure variation at the pressure sensor, and the sixth column denoted by "100" represents the ON/OFF timing of the operation of the high-pressure supply pump.

According to the above-described constant-amount ejection device of this Example, since the liquid feed unit is employed which is separated in terms of pressure from the pressure provided by the high-pressure pump, the high-viscosity material is supplied to the ejection device while the high-viscosity material is held in a state where the pressure variation is very small. Therefore, the high-viscosity material can be supplied from the ejection device with high accuracy free from a variation.

In addition, since the liquid feed unit can be disposed near the ejection device, a liquid feed path between them can be shortened and the pressure variation, such as pulsation, can be held at a minimum.

LIST OF REFERENCE SYMBOLS

13 ascent/descent guide
15 cylinder
16 movable plate
18 pump means
20 follow plate
21 can
23 delivery pipe
27 shovel body
28 shovel plate
29 shaft
30 air motor
50 selector valve
51 measuring hole
52 plunger
70 storage area
71 inlet port (receiving port)
72 delivery port
73 air pressure regulation port
74 liquid surface sensor (storage amount sensor)
75 pressure reducing valve
100 high-pressure supply pump
101 pressure sensor
200 liquid feed unit
300 storage unit
400 ejection unit (ejection device)
500 control unit
810 liquid feed pipe A
820 liquid feed pipe B
830 liquid feed pipe C

The invention claimed is:

1. A device for ejecting a high-viscosity material in a constant amount, the device comprising:

an ejection unit having an ejection port through which the high- viscosity material is ejected;

a storage unit having a storage area in which the high-viscosity material is stored, a receiving port through which the high-viscosity material is supplied to the storage area, and a delivery port through which the high-viscosity material is delivered to the ejection unit;

a high-pressure supply pump for supplying the high-viscosity material, which is filled in a container, to the storage unit under a first pressure; and a control unit, wherein a liquid feed unit is disposed in a flow path communicating the high-pressure supply pump and the storage unit with each other, the high-viscosity material is supplied to the storage unit by the liquid feed unit under a second pressure that is regulated to be lower than the first pressure, and the high-viscosity material is stored in the storage unit while a space regulated to be held at a third pressure is maintained in an upper portion of the storage area.

2. The device for ejecting the high-viscosity material in the constant amount according to claim 1, wherein the liquid feed unit supplies the high-viscosity material to the storage unit under the second pressure that is lower than the first pressure and higher than the third pressure.

3. The device for ejecting the high-viscosity material in the constant amount according to claim 1, wherein the delivery port is disposed in a lower portion of the storage area, the receiving port is disposed in the storage area at a position above the delivery port, and a cross-sectional area of the storage area is set to be larger than a cross-sectional area of the delivery port.

4. The device for ejecting the high-viscosity material in the constant amount according to claim 1, wherein a sensor for monitoring a storage amount of the high-viscosity material, which is stored in the storage unit, at a position above the receiving port is disposed in the storage unit, and the control unit operates the liquid feed unit in accordance with a signal from the sensor such that the high-viscosity material is replenished to the storage unit.

5. The device for ejecting the high-viscosity material in the constant amount according to any one of claims 1 to 4, wherein the liquid feed unit includes a pump mechanism for delivering the high- viscosity material supplied from the high-pressure supply pump to the storage unit, and a valve mechanism selectively taking a first position at which the liquid feed unit is communicated with the high-pressure supply pump and communication with the storage unit is cut off, and a second position at which the liquid feed unit is communicated with the storage unit and communication with the high-pressure supply pump is cut off.

6. A method for ejecting a high-viscosity material in a constant amount, the method preparing:

an ejection unit having an ejection port through which the high- viscosity material is ejected;

a storage unit having a storage area in which the high-viscosity material is stored, a receiving port through which the high-viscosity material is supplied to the storage area, and a delivery port through which the high-viscosity material is delivered to the ejection unit; and a high-pressure supply pump for supplying the high-viscosity material, which is filled in a container, to the storage unit under a first pressure, wherein a liquid feed unit including a pump mechanism and a valve mechanism is disposed in a flow path communicating the high-pressure supply pump and the storage unit with each other, the high-viscosity material is supplied to the storage unit by the liquid feed unit under a second pressure that is regulated to be lower than the first pressure, and the high-viscosity material is stored in the storage unit while a space regulated to be held at a third pressure is maintained in an upper portion of the storage area.

7. The method for ejecting the high-viscosity material in the constant amount according to claim 6, wherein the liquid feed unit supplies the high-viscosity material to the storage unit under the second pressure that is lower than the first pressure and higher than the third pressure.

8. The method for ejecting the high-viscosity material in the constant amount according to claim 6, wherein the delivery port is disposed in a lower portion of the storage area, the receiving port is disposed in the storage area at a position above the delivery port, and a cross-sectional area of the storage area is set to be larger than a cross-sectional area of the delivery port.

9. The method for ejecting the high-viscosity material in the constant amount according to claim 6, wherein a sensor for monitoring a storage amount of the high-viscosity material, which is stored in the storage unit, at a position above the receiving port is disposed in the storage unit, and the control unit operates the liquid feed unit in accordance with a signal from the sensor such that the high-viscosity material is replenished to the storage unit.

* * * * *

UNITED STATES PATENT AND TRADEMARK OFFICE

CERTIFICATE OF CORRECTION

PATENT NO. : 8,453,886 B2
APPLICATION NO. : 13/378076
DATED : June 4, 2013
INVENTOR(S) : Kazumasa Ikushima It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 35 days.

Signed and Sealed this
Eighth Day of September, 2015

Michelle K. Lee

Michelle K. Lee
*Director of the United States Patent and Trademark Office*